US005639160A

United States Patent [19]

Kishimoto

[11] Patent Number: 5,639,160

[45] Date of Patent: Jun. 17, 1997

[54] PLATFORM SHAKER IN THREE DIMENSIONAL MOTION

[76] Inventor: Masaru Kishimoto, 5-22-19, Mejiro, Toshima-ku, Tokyo, Japan, 171

[21] Appl. No.: 612,812

[22] Filed: Mar. 11, 1996

[30] Foreign Application Priority Data

Mar. 15, 1995 [JP] Japan ..... 7-055810

[51] Int. Cl.[6] ..... B01F 11/00

[52] U.S. Cl. ..... 366/208

[58] Field of Search ..... 366/110, 111, 366/208, 209, 210, 211, 213, 215, 216, 219

[56] References Cited

U.S. PATENT DOCUMENTS

| | | | |
|---|---|---|---|
| 760,664 | 5/1904 | Van Der Valk | 366/216 X |
| 2,527,556 | 10/1950 | Kost . | |
| 2,552,188 | 5/1951 | Krause et al. | 366/215 |
| 3,607,478 | 9/1971 | Henninges et al. | 366/208 X |

FOREIGN PATENT DOCUMENTS

| | | | |
|---|---|---|---|
| 55-020626 | 2/1980 | Japan . | |
| 5284961 | 11/1993 | Japan . | |
| 91/10503 | 7/1991 | WIPO | 366/209 |

*Primary Examiner*—Charles E. Cooley
*Attorney, Agent, or Firm*—Jeffrey C. Lew

[57] ABSTRACT

A platform shaker for stirring liquid chemical compositions provides a swirling motion in three dimensions. The magnitude of the three dimensional motion can be continuously adjusted while the shaker is in operation. Additionally, the platform of the shaker returns to the horizontal orientation after stirring is halted so as to maintain liquid samples well within the container placed on the platform. The novel platform shaker is useful for various analytical procedures such as DNA extractions, hybridizations, and gel staining in genetics, biology, and molecular biology. It is particularly appropriate for DNA extractions because the tilt angle of the platform as well as the swirl rate can adjust according to characteristics of the DNA, for example, to provide for a small tilt angle and a fast swirl rate for a short chain DNA, and for a large angle and a slow swirl rate for a long chain DNA.

3 Claims, 7 Drawing Sheets

PLATFORM SHAKER IN THREE DIMENSIONAL MOTION

FIELD OF THE INVENTION

This invention relates to a platform shaker for stirring materials such as chemical samples.

BACKGROUND AND SUMMARY OF THE INVENTION

This invention relates to a platform shaker in three dimensional motion, whose platform can move both forward/backward and left/right from its central position, swirl in a nutating rotational motion, maintain the horizontal level even when the operation of the platform shaker is halted, and operate with an adjustable mechanism to control the magnitude of the nutating rotational motion. Hence such platform shaker can be applied to analyses including DNA extractions, hybridizations, and gel staining in genetics, biology, and molecular biology by stirring samples which are mounted on the described platform. The platform shaker in three dimensional motion of this invention is particularly appropriate for DNA extractions because the tilt angle of the platform as well as the nutation rate can adjust according to characteristics of DNA's to provide for a small tilt angle and a fast nutation rate for a short chain DNA and for a large angle and a slow nutation rate for a long chain DNA.

The novel platform shaker in three dimensional motion can also be used for many other purposes including paper making by attaching a small paper making apparatus onto the platform, and stirring or mixing pieces of soft agar placed in a laboratory dish because the platform shaker can be operated in a nutating rotational motion and halted keeping the level of the platform horizontal.

FIG. 8 shows an embodiment of a conventional platform shaker with existing technology, which includes a motor 7 at the bottom of a box 1 and a horizontal cylindrical rotor 2 attached at the center of the bottom surface to the upward rotational axis 7*a* of the motor 7 directly below the aperture la located at the center of the top surface of the box 1. A straight hole with a finite depth 3 is drilled on the top surface of the horizontal rotor 2, into which the lower end of the nutating rotational rod 4 whose diameter is smaller than that of the straight hole 3 is inserted. The described nutating rotational rod 4 is supported by a bearing 5 of two, mutually fitting cylindrical parts in the middle portion of the nutating rotational rod 4 and also aligned approximately with the center of the horizontal cylindrical rotor 2. The described bearing 5 is fixed with an angled plate 8, which is fixed inside the box 1, through a support extension 5*a* to the angled plate 8. The upper end of the nutating rotational rod 4 points upward to the aperture 1*a* of the box 1, and is attached by inserting into the support unit 4*a* in order to hold the center of the platform 6 which is a flat and rectangular shape. The unit 9 is a stopper mechanism which causes the previously described nutating rotational rod 4 to nutate without self-axial rotational motions. The stopper mechanism consists of the stopper rod 9*a* which is fixed at the middle of the nutating rotational rod 4, and a framed piece 9*b* which is attached to the box 1. The stopper rod connects with the frame piece in a manner that allows the vertical oscillatory motion and simultaneously prevents a horizontal oscillatory motion of the stopper rod 9*a*.

With the conventional platform shaker described above, the platform 6 is tilted even when the platform shaker is halted, and hence it is impossible to keep the horizontal level of the surface of a liquid sample mounted on the platform 6 after stirring.

Also, it is impossible for the conventional platform shaker to continuously change the magnitude of the nutating rotational motion of the platform while it is being operated.

The platform shaker in three dimensional motion of this invention is designed to have capabilities of maintaining the horizontal level of the platform when the nutating motion of the platform is halted, and hence keeping the surface of a sample level after stirring. This invention also provides for changing the magnitude of the nutating rotational motion in a continuous manner while the shaker is being operated.

DETAILED DESCRIPTION

Figure 7:
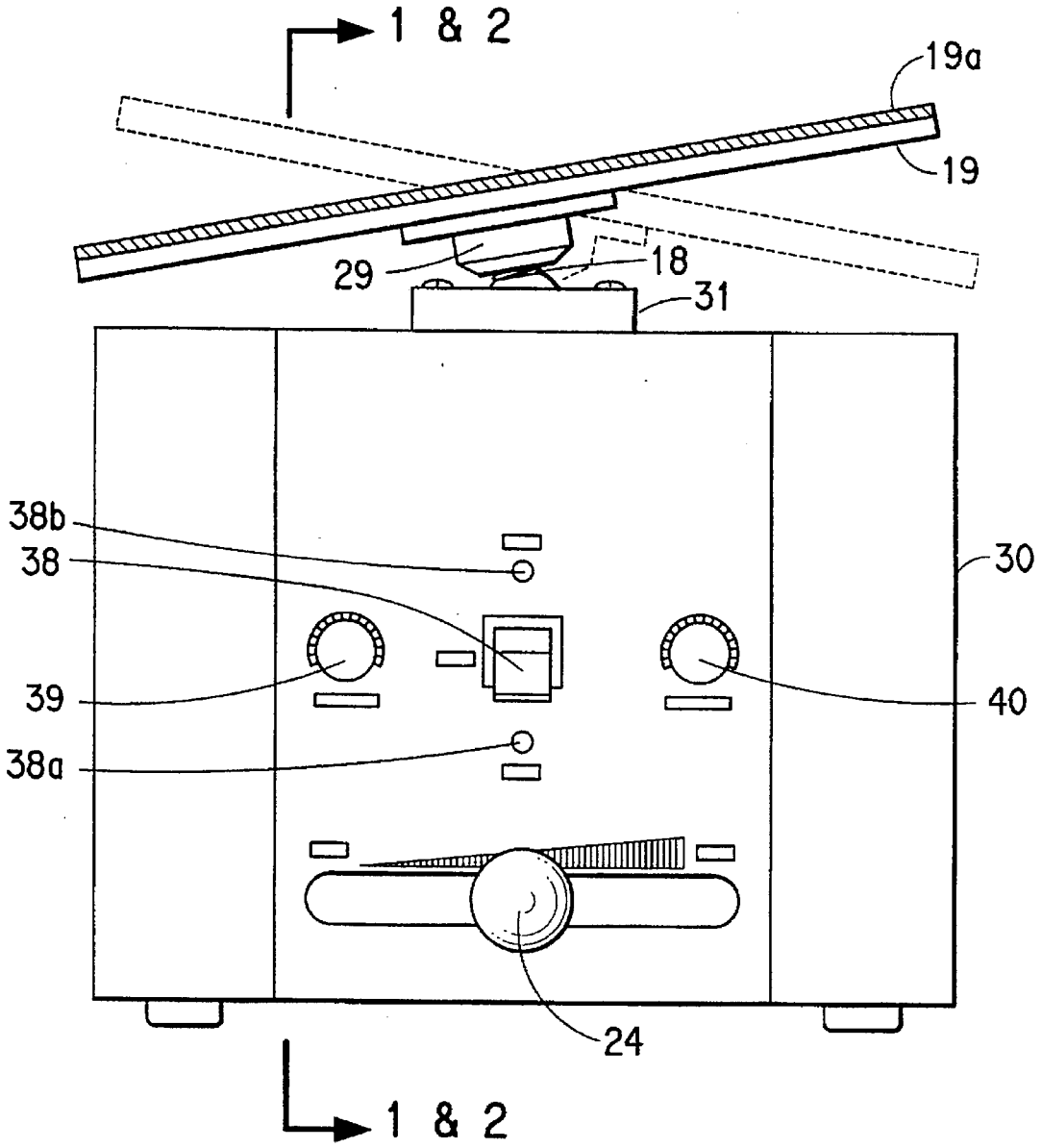
FIG. 7 is a front elevation view of a first embodiment of a shaker of this invention.
Figure 8:
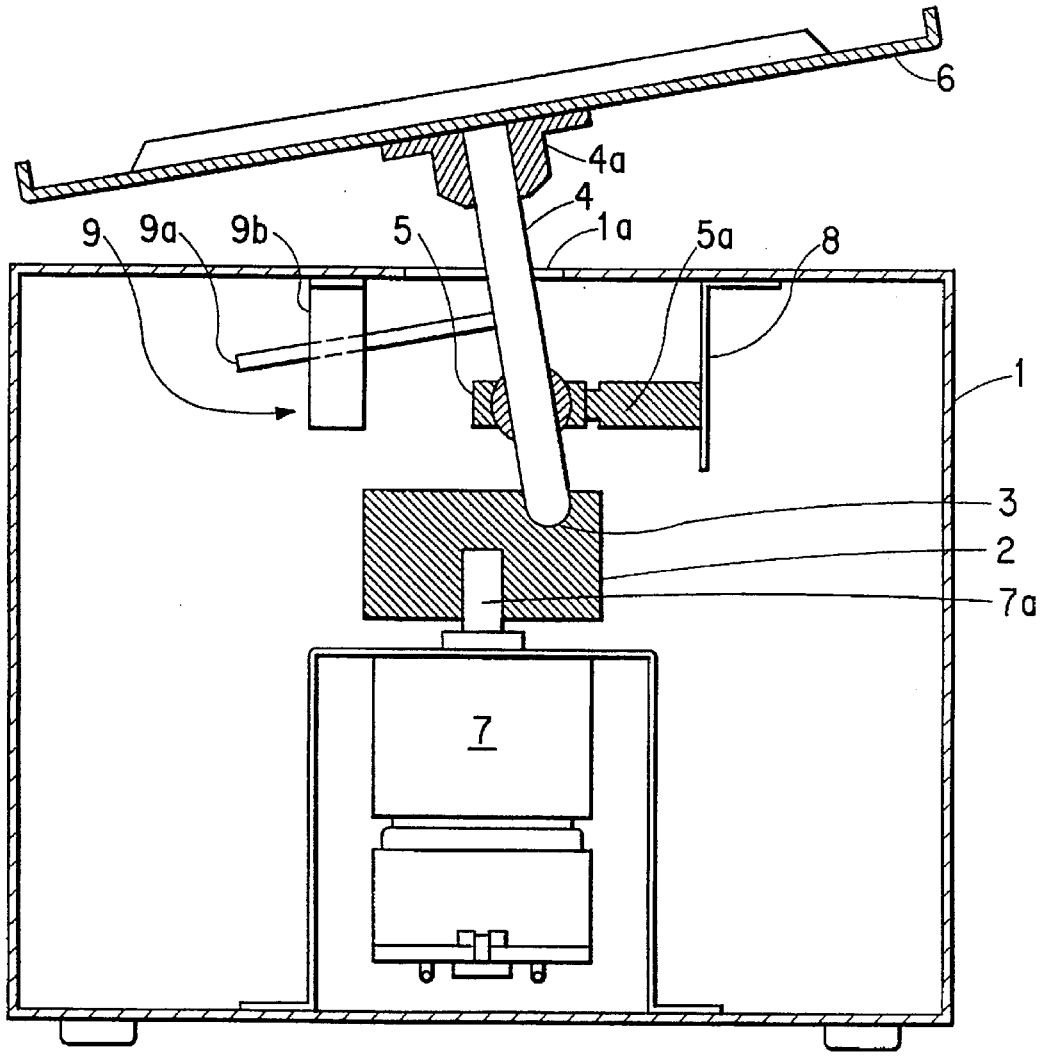
FIG.8 (PRIOR ART)
FIG. 8 is an elevation section view corresponding to the view along line 1—1 in FIG. 7 of a conventional shaker.

The present invention can be understood with reference to FIGS. 1–4 which illustrate various views of a first embodiment of the novel shaker shown in FIG. 7. Electronic system components, such as the power switch, timer indicator lamp, timer adjustment knob, and nutation adjustment knob, described more fully below, are not shown in FIGS. 1–4. In order to achieve the objects described above, this invention implements a platform shaker which swirls in a nutating rotational motion by configuring the following mechanism: the precessable shaft 14 is attached to the vertical, drive shaft 12 which is attached to motor drive shaft 11 of the motor 10 through the pivot pin 13 to achieve nutating rotational motions. A ball 15*a* which is configured at the lower end of the nutating member 15 is connected with the ball receptacle 16 at the upper end of the precessable shaft 14 in a manner to support the ball 15*a* without hindering its rotational motion and in order for the nutating member 15 to swirl freely without rotating about its own axis. The middle portion 15*b* of the nutating member 15 is supported free of swirling motion. A platform 19 is attached at the top portion 15*c* of the nutating member 15. The compressed spring 18 is inserted between the nutating member 15 and the spherical bearing 17. A rotor 20 which rotates about an axis perpendicular to the nutational axis of the precessable shaft 14 is attached to the side wall of the precessable shaft 14, and the rotor track base 21 for the rotor 20 is installed in order to provide the nutating rotation of the precessable shaft 14 with respect to the aforementioned vertical, drive shaft 12 by elevating the rotor track base 21 to contact the rotor track base 21 with the rotor 20. The rotor track base also can be disengaged from the rotor by lowering the rotor track base until it is separated from the rotor.

The elevation of the above-mentioned rotor track base 21 is achieved by attaching the vertical elevation rod 22, whose lower end is configured in a first spirally tapered surface 22*a*, to the bottom surface of the rotor track base 21; installing the elevation control shaft 23, whose upper end is configured in a second spirally tapered surface 23*a* which follows a cam motion with the spirally tapered surface 22*a* at the lower end of the elevation rod 22, and installing the lever 24 which is attached to the elevation control shaft 23 for turning the elevation control shaft 23.

Figure 5:
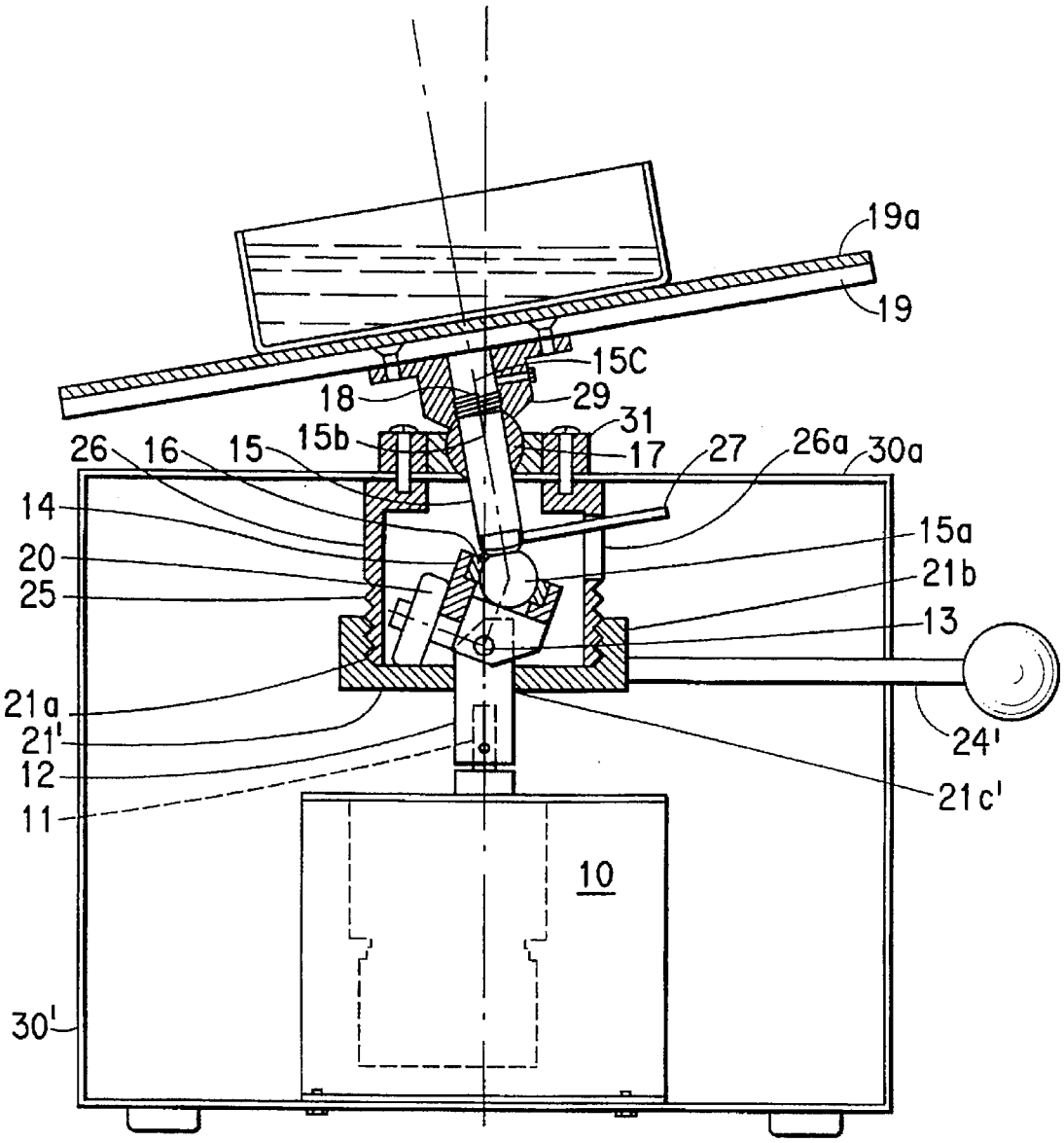
FIG. 5 is an elevation section view corresponding to the view along line 1—1 in FIG. 7 of a second embodiment of a shaker according to this invention.
Figure 6:
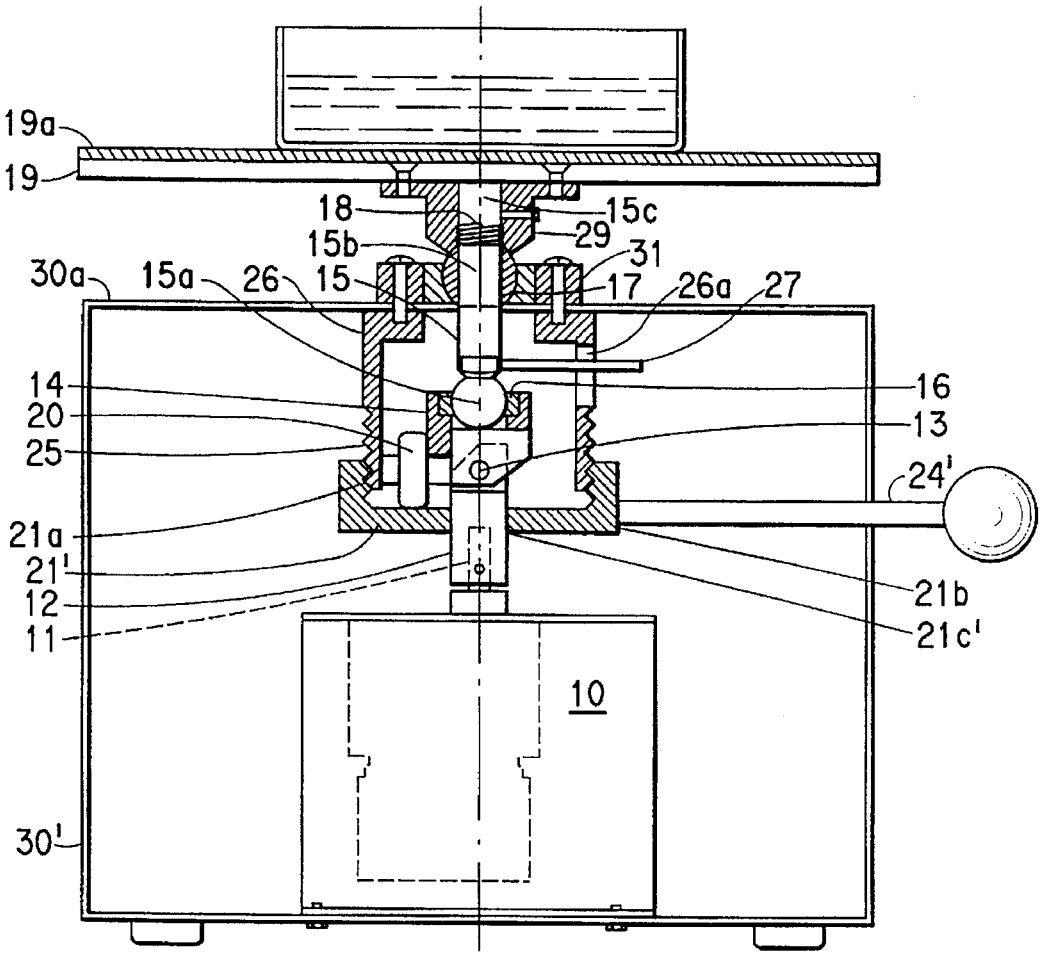
FIG. 6 is the same view as FIG. 5 when the platform is kept level.

A different mechanism for adjusting the elevation of the rotor track base is shown in FIGS. 5 and 6. Like elements in all the Figures are given like reference numerals. Lever 24' is attached to the outer wall 21*b* of the previously mentioned rotor track base 21'. By engaging the female thread 21*a* on the inner surface of the outer wall of the rotor track base 21' with the matching male thread 25 on the non-moving portion of fixture unit 26, the lever can be manipulated to adjust elevation of the rotor track base.

When the rotor track base 21 position is lowered such that rotor 20 loses contact with rotor track base 21, the nutating member 15 is pushed upward by the compressed spring 18 inserted between the platform 19 which is fixed at the top portion 15*c* of the nutating member 15 and the spherical bearing 17 which supports the free nutating rotational motion of the middle portion 15*b* of the nutating member 15. Hence the nutating member 15 is stood upright, thereby keeping the platform 19, which is fixed at the top portion 15*c* of the nutating member 15 horizontal. Consequently the level of the liquid surface of a sample on the platform will be maintained in the sample container.

Also, the magnitude of the nutating rotational motion of the platform 19 while in its operation can be changed continuously by adjusting the vertical position of the rotor track base 21. This can be done by turning the aforementioned lever 24, causing elevation control shaft 23 to force elevation rod 22 up or down following the cam motion of first and second spirally tapered surfaces 22*a* and 23 a. As seen in FIG. 5, female thread on the inner surface of the outer wall of the rotor track base 21' moves with the matching male thread 25 configured on the non-moving portion 26, to cause the subsequent elevation of the rotor track base 21' when lever 24' is manipulated.

In FIGS. 1–4, the unit 10 is the motor attached to the inside of the box 30, the unit 12 is the vertical, drive shaft attached to the motor drive shaft 11 of the motor 10, the unit 14 is the precessable shaft connected with the vertical, drive shaft 12 through the pivot pin 13 maintaining free nutation rotations, the unit 15 is the nutating member, the ball 15*a* configured at the lower end of the nutating member 15 is connected with the ball receptacle 16 at the top portion of the precessable shaft 14 maintaining free rotations, the middle portion 15*b* of the nutating member 15 is supported by the nutating member support part 31 in the box 30 through the spherical bearing 17, the top portion 15*c* of the nutating member 15 is attached to the platform fixture 29 through the spring 18 inserted between the spherical bearing 17 and the middle portion 15*b*, and the platform 19 is fixed with the platform fixture 29. By attaching an adhesive sheet 19*a* on the surface of the platform 19, flasks, beakers, laboratory dishes, and plastic laboratory ware can be placed on the platform 19 without skidding off.

The unit 20 is the rotor which is attached to one end of the previously mentioned precessable shaft 14 for perpendicular rotation to the precessable shaft 14, and the unit 21 is the rotor track base for the rotor 20, which is either uncontacted or contacted with the rotor 20 by elevating the rotor track base 21 in order to tilt the precessable shaft 14 with respect to the vertical, drive shaft 12. When the motor 10 rotates in such condition of axially off-centered alignment of rotational axes, the nutating member 15, whose lower end is configured the ball 15*a* connected with the bearing receptacle 16 at the top end of the previously described precessable shaft 14 maintaining a free rotational motion, swirls while the middle portion 15*b* being supported by the spherical bearing unit 17, and hence the platform 19 which is fixed at the top portion 15*c* of the nutating member 15 swirls in a nutating rotational motion. The magnitude of the nutation is changed as the tilt angle of the previously described nutating member 15 is changed by means of the rotor track base 21 being elevated.

The means of elevating the above-mentioned rotor track base 21 is as follows. The previously mentioned vertical, drive shaft 12 is fitted into the drilled through hole 21*c* at the center of the rotor track base 21 for maintaining free elevation. The pair of elevation support plates 32, 32 is vertically installed facing each other in the vicinity of the drilled through hole 21*c* and supported by pairs of pulleys 33, 33 at the vertical edges of the elevation support plates 32, 32, supporting the rotor track base 21 for free elevations while keeping the horizontal level, the elevation rod 22 whose bottom end is configured the spirally tapered surface 22*a* is vertically installed, and the elevation control shaft 23 whose top end is configured the spirally tapered surface 23*a* which is fitted to the spirally tapered surface 22*a* at the bottom end of the elevation rod 22 is installed, with the lever 24 attached to the elevation control shaft 23 for turning the elevation control shaft 23.

Figure 4:
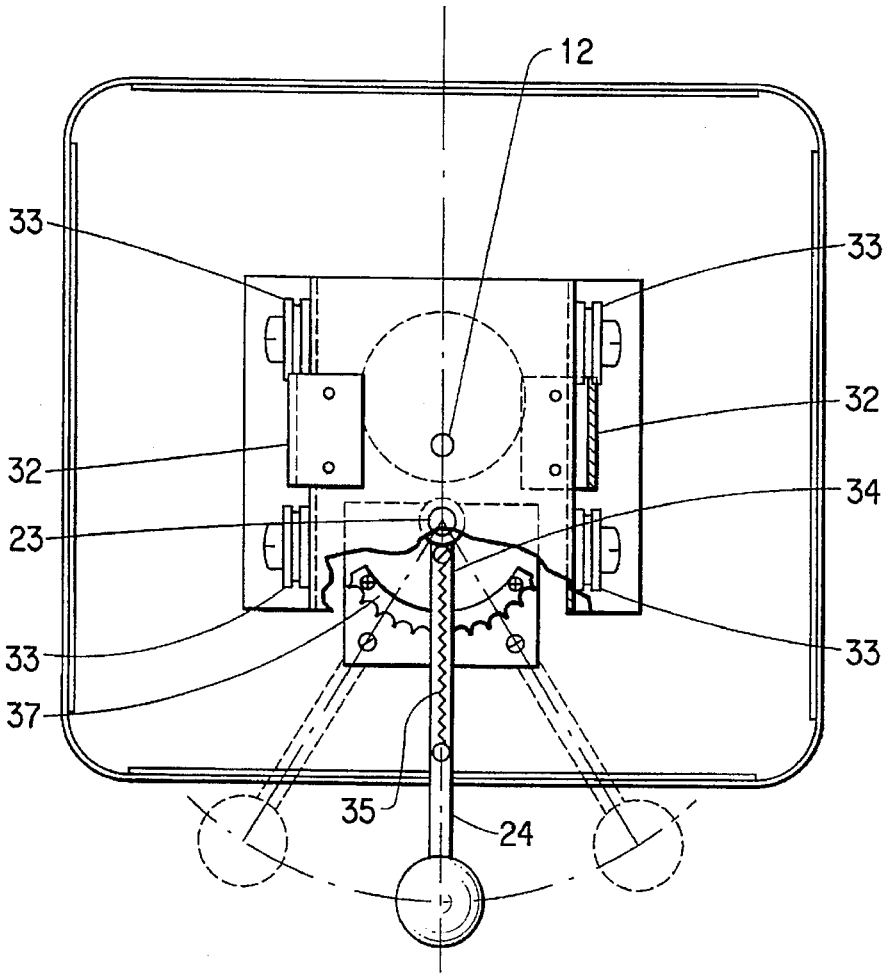
FIG. 4 is a plan section view taken along line 4—4 in FIG. 1.

The aforementioned lever 24 is attached to the aforementioned elevation control shaft 23 in the following manner. The lever support piece 34 is fixed at the one end of elevation control shaft 23 in such a manner as the tip portion of the lever 24 can be supported in order to be fitted freely, the expanded spring 35 is installed between the lever support piece 34 and the lever 24 fitted to rotate freely to the lever support parts 34, the pin 36 is vertically installed at the tip of the lever 24, and the toothed arc unit 37 into which the pin 36 is inserted is installed as shown in FIG. 4. When the lever 24 is to be turned to the desired position, the lever 24 is pulled against the spring 35 in order to detach the vertical pin 36 from the toothed arc unit 37, and then such desired position is held by releasing the lever 24 to inserted the vertical pin into the toothed arc unit 37.

Figure 3A:
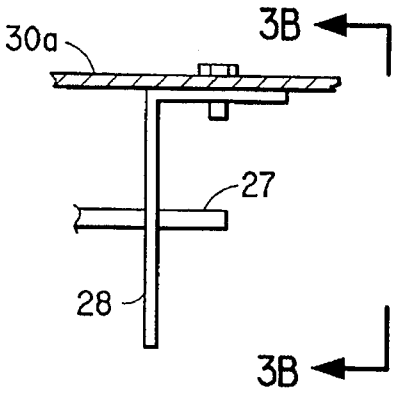
FIG. 3*a* is a detail view of FIG. 1 showing a means of nutation rotation which excludes self-axial rotations.
Figure 3B:
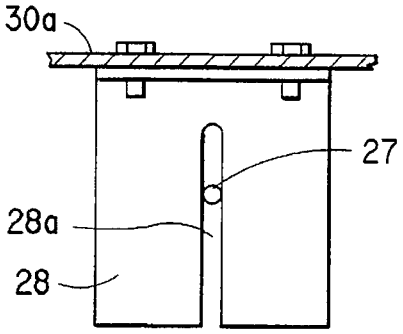
FIG. 3*b* is a view taken along line 3*b*–3*b* in FIG. 3*a*.

The unit 27 is an extension rod protruding perpendicularly from the side of the previously mentioned nutating member 15, and such extension rod 27 is inserted into the slit 28*a* of the slitted angle unit 28 which is vertically installed on the ceiling plate 30*a* of the box 30 as shown in FIGS. 3*a* and 3*b* for the aforementioned nutating member 15 swirling without self-axial rotations.

FIG. 5 shows the vertical cross section of the second embodiment of the invented platform shaker. FIG. 6 is the vertical cross section of the same shaker when the horizontal level of the platform is held. The difference of the second embodiment from the aforementioned first embodiment is the means of elevating the previously described rotor track base 21'. In other words, the drilled through hole 21*c'* at the center of the rotor track base 21' is made to insert the vertical, drive shaft 12 to elevate the rotor track base 21' and support itself, the female thread 21*a* is formed on the inner wall of the previously mentioned rotor track base 21', and the male thread 25 which is matched with the female thread 21*a* is formed on the fixture part 26 which is vertically installed on the inner surface of the ceiling 30*a* of the box 30', and the lever 24' is attached to the outer wall 21*b* of the previously mentioned rotor track base 21'. Some fixture unit can be installed to the lever 24' in order to hold the desired position without rotations. Also, the extension rod extended perpendicularly from the side of the previously mentioned nutating member 15 is inserted into the vertical slit 26*a* which is formed on the side wall of the previously mentioned non-moving portion 26.

FIG. 7 shows the front view of the outside of the platform shaker in three dimensional motion of this invention, where the unit 38 is the switch for the power and the timer selection, the unit 38*a* is the power indicator lamp, the unit 38*b* is the timer indicator lamp, the unit 39 is the timer adjustment knob, and the unit 40 is the adjustment knob of the nutation rate of the platform shaker. This platform shaker can be operated continuously with the power ON by the switch 38, or for a desired time period which is set by the timer adjustment knob 39 while the timer ON, furthermore, the nutation rate of the platform 19 is adjustable with the nutating rotation adjustment knob 40 of the platform shaker.

Figure 1:
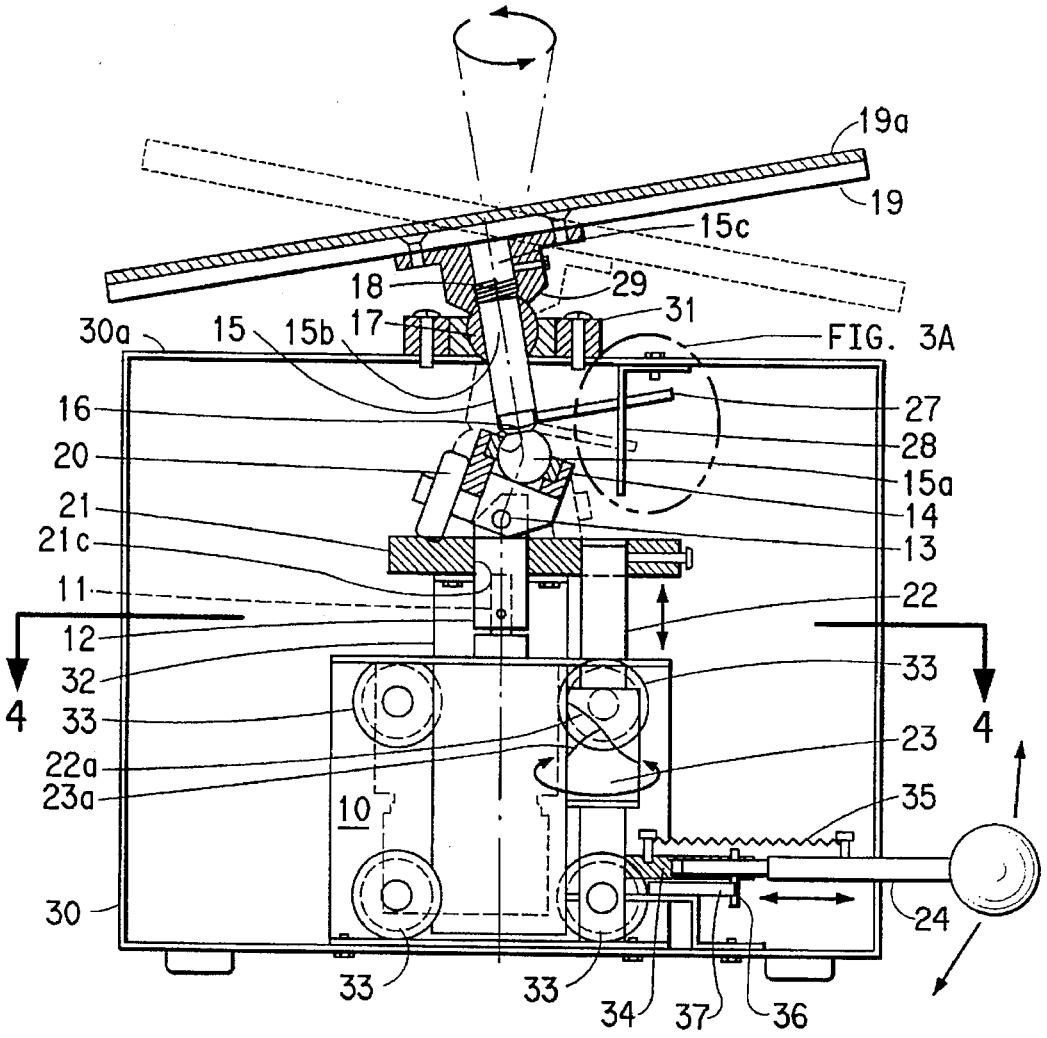
FIG. 1 is an elevation section view taken along line 1—1 in FIG. 7 of a first embodiment of a shaker according to the present invention.
Figure 2:
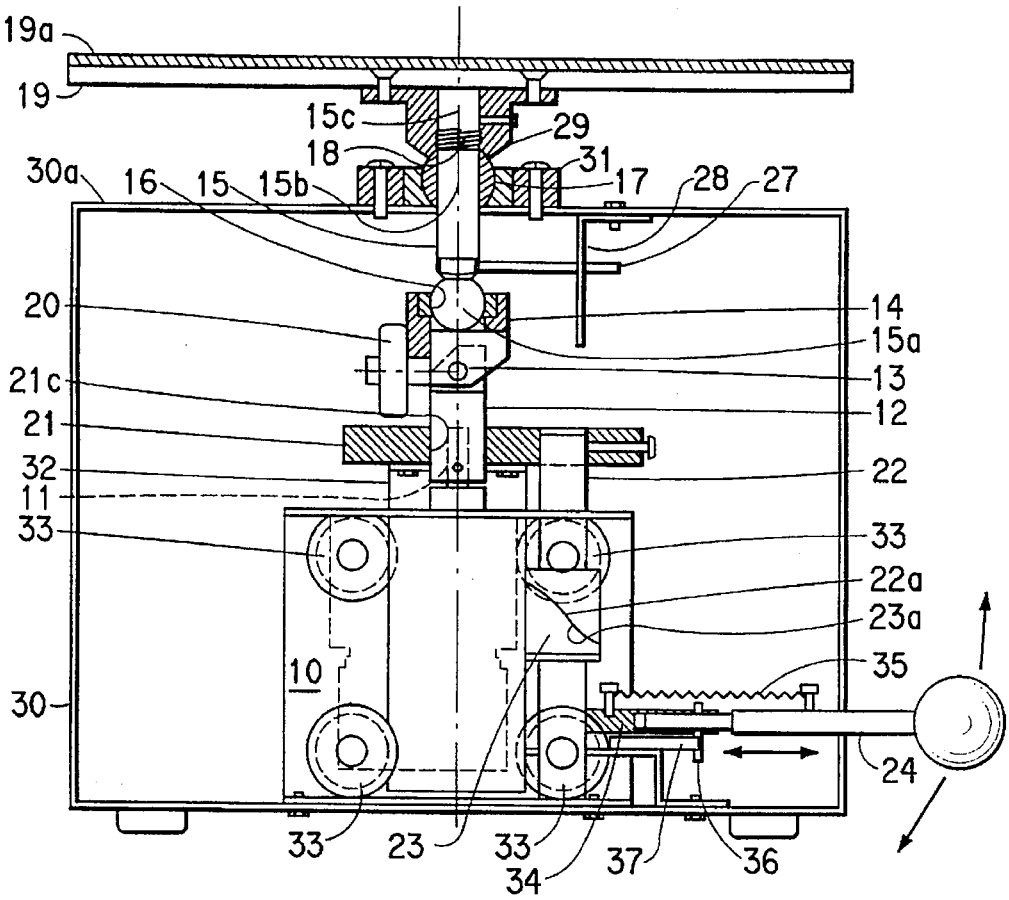
FIG. 2 is an elevation section view taken along line 2—2 in FIG. 7 when the platform is kept level.

Next, the operation of the invented platform shaker in a nutating rotational motion is described. As shown in FIGS. 6 and 2, the previously described rotor track base 21' can be disengaged from the rotor 20, which is attached to the side wall of the precessable shaft 14 in order for the perpendicular rotation to the precessable shaft 14, by means of lowering the rotor track base 21'. The previously described nutating member 15 is pushed upward by the compressed spring 18 inserted between the spherical bearing 17 which supports the middle part 15*b* of the nutating member 15. Thus the nutating rotational motion halts and the horizontal level of platform 19 is maintained. Consequently horizontal level of the surface of a liquid sample remains in its container after stirring.

Also, even while the platform 19 is in motion, the magnitude of the nutating rotational motion can be changed by adjusting the previously described lever 24 to shift the elevation control shaft 23. This raises the rotor track base 21 by raising the previously described elevator rod 22 by means of fitting the spirally tapered surface 23*a* which is at the top end of the elevation control shaft 23 with the spirally tapered surface which is the bottom end of the elevator rod 22.

Also, as seen in FIG. 5, while the platform 19 is in its operational motion, the magnitude of the nutation can be changed by adjusting the lever 24' to turn the rotor track base 21' for elevation through the female thread on the inner wall of the rim of the rotor track base 21' matched with the male thread 21*a* formed on the non-moving portion 26.

What is claimed is:

1. A platform shaker which swirls a sample in three dimensional motion, comprising:

a nutating member having a spherical, ball-shaped end, an upper end distant from the ball-shaped end, and a middle portion intermediate the upper end and the ball-shaped end;

a precessable shaft having a nutational axis and being pivotally coupled to a vertical drive shaft attached to a motor drive shaft driven by a motor, the precessable shaft including a concave ball receptacle adapted to receive the ball-shaped end of the nutating member so as to allow the ball-shaped end to swivel freely without rotation of the nutating member and without hindering rotational motion of the vertical drive shaft, and a circular rotor attached to a side wall of the precessable shaft capable of rotating about an axis perpendicular to the nutational axis;

a box having a side structure and top enclosing the motor and the precessable shaft, the top having a centrally located opening through which the upper end of the nutating member extends, the middle portion of the nutating member being pivotally engaged by a spherical bearing mounted in a support unit affixed to the top;

a platform for supporting samples to be stirred, the platform having a platform fixture for affixing the upper end of the nutating member to the platform;

a compressed spring along the nutating member and biased between the platform fixture and the support unit; and a rotor track base for the rotor having a central bore to slidably engage the vertical drive shaft, the rotor track base to provide nutating rotational motions of the precessable shaft with respect to the vertical drive shaft by elevating the rotor track base in contact with the rotor, wherein the rotor track base can be lowered to disengage from the rotor, whereby the compressed spring forces the nutating member to stand upright causing the platform to be horizontal when the nutating rotational motion is halted.

2. A platform shaker as recited in claim 1 further comprising a mechanism to adjust elevation of the rotor track base including an elevation rod attached to the rotor track base and extending vertically downward, the elevation rod having a bottom end distant from the rotor track base configured with a first spirally tapered surface;

a vertically oriented, elevation control shaft having a top end configured with a second spirally tapered surface adapted to bias against the first spirally tapered surface; and a lever attached at a first end to the elevation control shaft and extending through a slot in the side structure of the box to terminate at a handle end, wherein rotor track base elevation is adjusted by moving the lever to turn the elevation control shaft, thereby causing the first spirally tapered surface to follow in a cam motion the second spirally tapered surface.

3. A platform shaker as recited in claim 1 further comprising a mechanism to adjust elevation of the rotor track base including a hollow, vertically cylindrical fixture unit fixedly attached within the box to enclose the precessable shaft, the fixture unit having a lower end configured with male screw threads; and wherein the rotor track base comprises a circular disc having a circumference and an upwardly extending wall at the circumference, the wall including female screw threads adapted to mate with the male screw threads of the fixture unit, the rotor track base further including a lever attached at a first end to the wall and extending through a slot in the side structure of the box to terminate at a handle end allowing rotor track base elevation adjustment by moving the lever to turn the rotor track base.

* * * * *